US005990795A

United States Patent [19]

Miller

[11] Patent Number: 5,990,795

[45] Date of Patent: Nov. 23, 1999

[54] SLEEP WARNING DEVICE FOR MOBILE VEHICLES

[76] Inventor: Bernard J. Miller, 882 Andorra Rd., Lafayette, Pa. 19444

[21] Appl. No.: 09/245,457

[22] Filed: Feb. 5, 1999

Related U.S. Application Data

[60] Provisional application No. 60/074,339, Feb. 6, 1998.

[51] Int. Cl.[6] ..... G08B 23/00

[52] U.S. Cl. ..... 340/576; 340/439; 701/70; 180/272

[58] Field of Search ..... 340/576, 439, 340/575, 425.5; 180/272, 273; 701/70

[56] References Cited

U.S. PATENT DOCUMENTS

| | | | |
|---|---|---|---|
| 3,703,217 | 11/1972 | Kulick et al. | 340/576 |
| 3,861,349 | 1/1975 | Conley | 340/576 |
| 4,203,098 | 5/1980 | Muncheryan | 340/576 |
| 5,508,685 | 4/1996 | Monte, Jr. | 340/576 |
| 5,568,127 | 10/1996 | Bang | 340/576 |
| 5,585,785 | 12/1996 | Gwin et al. | 340/576 |
| 5,813,989 | 9/1998 | Saitoh et al. | 340/576 |

*Primary Examiner*—Nina Tong
*Attorney, Agent, or Firm*—Caesar, Rivise, Bernstein, Cohen & Pokotilow, Ltd.

[57] ABSTRACT

This invention provides a means of awakening the sleeping or unconscious operator of the vehicle by sounding a loud alarm with a recorded message within the cabin as well as alerting nearby and opposing drivers of other vehicles in motion that the involved vehicle is out of control. The invention involves securing to a shoulder belt a capacitance element including circuits to bring about a change in capacitance in the event of nodding of the operator's head.

3 Claims, 2 Drawing Sheets

DROWSY SLEEP - SENSOR ACTIVATED

FIG.1
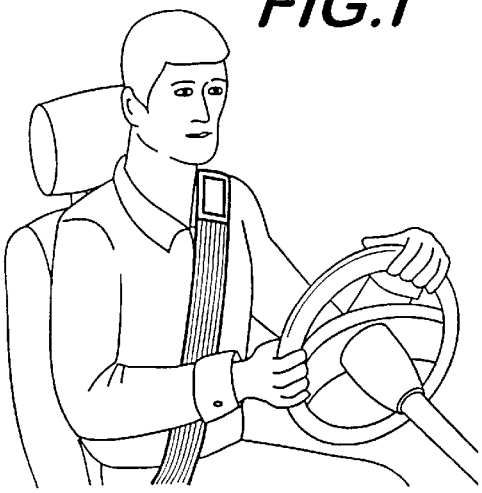
SEAT BELT WITH SENSOR
FIG.2
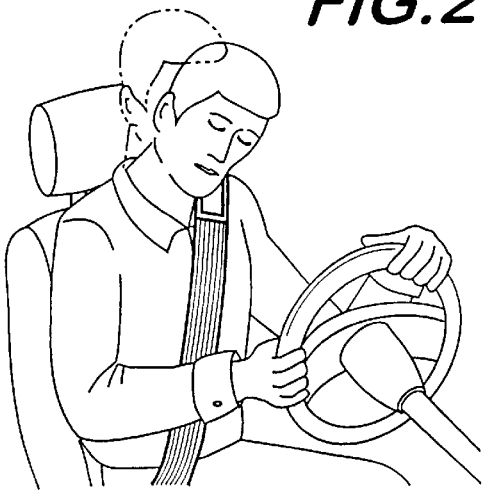
DROWSY SLEEP - SENSOR ACTIVATED
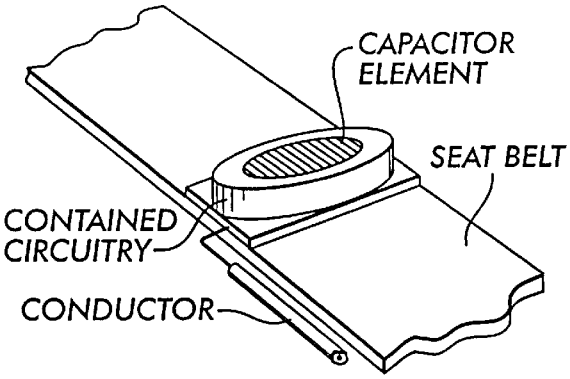
SENSOR WITH CONTAINED CIRCUITRY
FIG.3
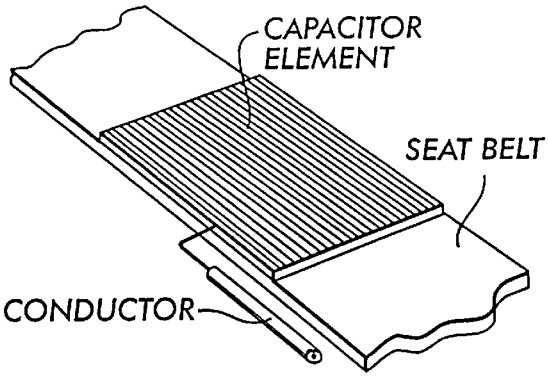
SENSOR WITH REMOTE CIRCUITRY
FIG.4
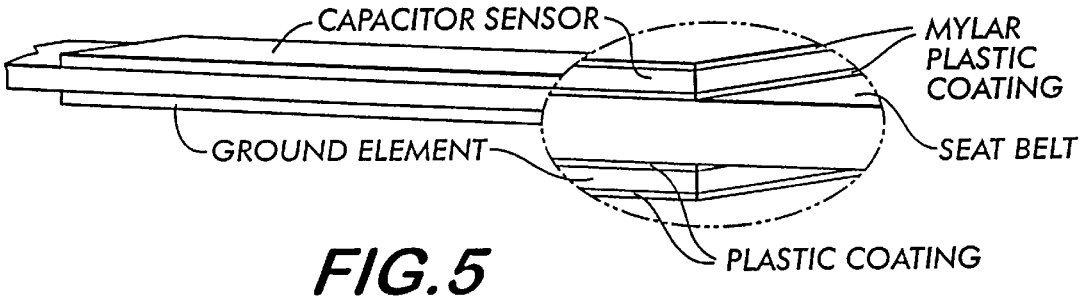
FIG.5

SLEEP WARNING DEVICE FOR MOBILE VEHICLES

This application claims benefit of Provisional Application Ser. No. 60/074,339 filed Feb. 6, 1998.

BACKGROUND OF THE INVENTION

Despite the fact that numerous highway accidents result in situations in which a sleeping driver is out of control of his vehicle, no device which awakens a sleeping driver of a vehicle in motion is available today. Various devices for awakening sleeping drivers in such situations have been described in patent literature. Such devices are impractical, cumbersome to wear and hence may not be worn, or mechanically unreliable. For example: U.S. Pat. No. 4,209,075 (Messina) employs a spring attached to the seat belt. When the driver slumps forward, the tension on the seat belt is sufficient to increase the tension on the spring which is in turn controls various components of the vehicle.

U.S. Pat. No. 5,691,693 (Kithil). This invention employs at least three capacitive sensors, placed in the headliner of the vehicle and above the operator's head which senses changes in position and motion. The output of the sensors are analyzed by a micro processor which in turn activates various warning devices to alert the operator.

U.S. Pat. No. 5,689,241 (Clarke, Sr. et al.) This invention consists of a unit placed around the rearview mirror or the dashboard and contains an infrared auto focusing device to sense changes in position of the head. In addition, the unit contains a heat sensor which evaluates the temperature around the face area. This assumes a decrease in temperature about the face resulting from a decrease in respiration which occurs during sleep.

U.S. Pat. No. 5,682,144 (Mannik) This device attaches to the driver's eyeglasses. A beam of narrow band infrared or ultrasound senses whether the driver's eyelids are in a closed or open position.

U.S. Pat. No. 4,953,111 issued on 1990 (Yamamoto and Tanaka). This device detects the blink rate of the driver's eyes regardless of the position of the iris and uses at least two reflection type sensors. The duration of the blink is then used to determine whether the user is beginning to doze. An alarm is then produced to awaken the driver.

U.S. Pat. No. 5,469,143 November 1995 (Cooper). This device consists of eye glasses which contain a sensing lever in contact with one of the driver's upper eyelids. Downward motion of the eyelid moves the sensing lever downward which in turn activates a micro switch coupled to the sensing lever. The micro switch activates circuitry in the control unit to turn on a light each time the eyelid closes.

U.S. Pat. No. 5,684,461 November 1997 (Jones). This consists of a U-shaped headset which includes a mercury switch assembly. The mercury switch is closed with a forward tilting of the head. The unit, however, does require a headset.

U.S. Pat. No. 5,522,092 June 1996 (Streb, et. al.) This consists of a head cap operating a number of micro switches which detect forward and backward motion of the head. With tilting of the head switches then activate an alarm.

U.S. Pat. No. 5,353,013 October 1994 (Estrada). This device consists of a headset with a reflector mounted on the top. An incident optical beam is directed from a forward positioned light source. The optical emitter and receiver system is arranged so that the head position is sensed by displacement of the beam which in turn activates the alarm system to emit a loud alarm. This also requires a headset.

U.S. Pat. No. 5,195,606 March 1993 (Martyniuk). This is a switch activated by a piston cylinder which in turn activates the brake pedal or vacuum operated brake system.

U.S. Pat. No. 4,928,090 May 1990 (Yoshimi, et. al.) This device measures the skin potential for determining arousal level. It does so by a complex measurement of skin potential level which varies with sleep.

U.S. Pat. No. 4,489,375 November 1984 (Hershberger) This consists of a push button alarm switch mounted on the steering wheel whereby the driver's hand concurrently grips the steering wheel and switch. The alarm switch is activated when the driver's grip on the steering wheel is relaxed or in sleep.

U.S. Pat. No. 4,259,665 March 1981 (Manning). The device measures the electrical conduction between the driver's hand and the steering wheel. With relaxation of grip, the hand falls from the steering wheel and the safety system is activated.

U.S. Pat. No. 3,964,045 June 1976 (Conley). This invention requires the driver to wear a glove which is in turn connected to a switch. With sleep and relaxation the gloved hand falls from the steering wheel increasing tension on the cord which is connected to the switch. At this point the alarm is activated.

U.S. Pat. No. 5,559,495 September 1995 (Cochran). A sleep preventing alarm including timer circuitry for selectively transmitting a periodic indicator signal upon completion of a characteristic time interval in one of a number of modes of operation.

SUMMARY OF INVENTION

The principle which serves as a basis for this invention is the continuous measurement of the electrical capacitance between the neck and shin of the operator of the vehicle or other mobile vehicle such as a boat, and a capacitance sensor which is an integral element of the seat belt. As the head tilts forward in impending or deep sleep, the change in electrical capacitance between the driver's head and the seat belt sensor secured to a shoulder belt, then activates the audible alarm and lights within the vehicle and in addition where desired, an the external flashing light system is also activated to alert nearby vehicles. With nodding of the head in impending sleep, the lower signal derived from the capacitor is sufficient to sound the audible alarm. With further depression of the head in deep sleep, the increased signal actuates the external warning lights in addition. When the driver awakens, the head and neck then assume the normal erect position, and the capacitance between the seat belt sensor and the head returns to the initial level and the alarm becomes inoperative.

DESCRIPTION OF DRAWINGS

FIG. 1 is a view showing the position of the capacitance sensor within the shoulder belt of a seat belt assembly.

FIG. 2 is similar to FIG. 1 but showing activation of the capacitance sensor with depression of the head as in nodding, deep sleep or unconsciousness.

FIG. 3 shows a seat belt with the contained circuitry.

FIG. 4 shows a capacitance sensor with remote circuitry attached to a seat belt.

FIG. 5 shows details of the seat belt capacitor sensor; and

DETAILED DESCRIPTION OF THIS INVENTION

Figure 6:
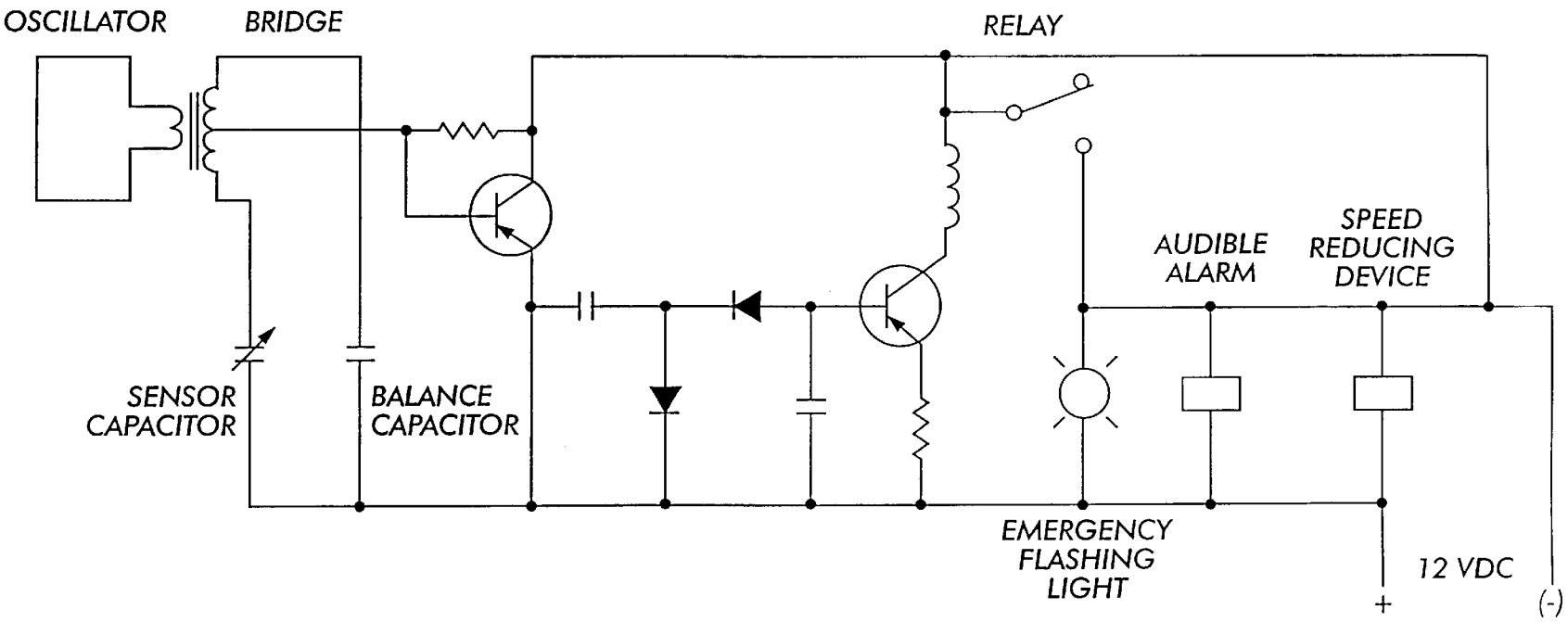
FIG. 6 is the capacitor sensor circuit used with the present invention.

The seat belt capacitor (FIG. 1) consists of a thin sheet of brass measuring 1.75 inches by 2.25 inches by 0.02 in thickness and is encapsulated between two layers of plastic dielectric (FIG. 4 FIG. 5) The capacitance element may be secured to the seat belt with Velcro fastener thus providing for optimal positioning of the capacitor element initially or it may be manufactured within the seat belt. A ground reference element is mounted on the deep surface of the seat belt and rests in permanent contact with the driver's body. With the removal placement of the circuitry in relation to the sensor (FIG. 4) the two units are then interconnected with a segment of a coaxial conductor. The coaxial conductor is not required when the capacitor and circuitry are contained within the same unit (FIG. 3)

The electronic circuitry (FIG. 6) operates on the vehicle's battery source and consists in the preferred embodiment of a 10K Hertz oscillator driving an amplifier with an interstage transformer output. The basic capacitor circuit consists of the center tapped secondary of an interstage transformer, the seat belt capacitor as one arm of the bridge and a balancing capacitor in the remaining arm. The bridge is balanced to zero output when the driver is awake, his chin extended, head erect, and the seat belt with capacitor is in position. With nodding of the head on impending or deep sleep, the change in position of the head with reference to the seat belt capacitor results in a change in electrical capacitance. At this point, the unbalance signal actuates the relays which in turn control the loud audible alarm with a programmed message within the cabin and where desired, internal and external blinking lights. A device for reducing the speed of the vehicle may also be included.

REFERENCES CITED

These consist of:

U.S. Pat. No. 4,209,075 June 1980 Messina
U.S. Pat. No. 5,691,693 November 1997 Kithil
U.S. Pat. No. 5,689,241 November 1997 Clarke, Sr., et al.
U.S. Pat. No. 4,953,111 August 1990 Yamamoto, et. al.
U.S. Pat. No. 5,682,144 October 1997 Mannik
U.S. Pat. No. 5,469,143 November 1995 Cooper
U.S. Pat. No. 5,402,109 March 1993 Mannik
U.S. Pat. No. 4,555,697 November 1985 Thackrey
U.S. Pat. No. 5,684,461 November 1997 Jones
U.S. Pat. No. 5,552,092 June 1996 Streb et. al.
U.S. Pat. No. 5,353,013 October 1994 Estrada
U.S. Pat. No. 5,195,606 March 1993 Martyniuk
U.S. Pat. No. 4,928,090 May 1990 Yoshimi et. al.
U.S. Pat. No. 4,485,375 November 1984 Hershberger
U.S. Pat. No. 3,964,045 June 1976 Conley et. al.
U.S. Pat. No. 5,559,495 September 1996 Cochrqn Without further elaboration the foregoing will so fully illustrate our invention that others may, by applying current or future knowledge, adopt the same for use under various conditions of service.

I claim:

1. A sleep warning device responsive to nodding of the head of an operator of a mobile vehicle, said device comprising a seat belt including a shoulder belt to which a capacitance element including a capacitor circuit is adjustably secured, electronic circuitry operating on the vehicle's battery source, said circuitry comprising an oscillator driving an amplifier with an interstage transformer output, the basic capacitor circuit including a center tapped secondary of an interstage transformer, said seat belt capacitance element being one arm of a bridge and a balancing capacitor being in the remaining arm whereby there is a change in electrical capacitance upon nodding of the operator's head to activate a warning circuit.

2. The device of claim 1 wherein the circuitry is contained in a housing which is attached to the shoulder belt.

3. The device of claim 1 wherien there is a capacitance sensor attached to the shoulder belt.

* * * * *